United States Patent [19]

Pirdzuns et al.

[11] Patent Number: 4,821,009

[45] Date of Patent: Apr. 11, 1989

[54] OVERCURRENT-PROTECTIVE SNAP SWITCH FOR HOUSEHOLD APPLIANCES

[75] Inventors: Rolf Pirdzuns, Wuppertal; Wolfgang Polligkeit; Michael Schluckebier, both of Ennepetal, all of Fed. Rep. of Germany

[73] Assignee: Vorwerk & Co. Interholding GmbH, Wuppertal, Fed. Rep. of Germany

[21] Appl. No.: 145,269

[22] Filed: Jan. 19, 1988

[30] Foreign Application Priority Data

Jan. 17, 1987 [DE] Fed. Rep. of Germany ..... 3701275

[51] Int. Cl.[4] ..... H01H 61/06; H01H 71/18

[52] U.S. Cl. ..... 337/130; 337/132; 337/139

[58] Field of Search ..... 337/126, 130, 131, 132, 337/135, 139, 384, 389, 390, 391, 56, 91, 348, 367

[56] References Cited

U.S. PATENT DOCUMENTS

| | | | |
|---|---|---|---|
| 2,200,108 | 5/1940 | Wilckens | 200/147 |
| 2,913,557 | 11/1959 | Immel | 200/147 |
| 4,325,046 | 4/1982 | Burch | 337/56 |
| 4,404,443 | 9/1983 | Coynel et al. | 200/147 A |

FOREIGN PATENT DOCUMENTS

| | | |
|---|---|---|
| 1513242 | 4/1971 | Fed. Rep. of Germany . |
| 2621478 | 11/1977 | Fed. Rep. of Germany . |
| 3327311 | 9/1984 | Fed. Rep. of Germany . |
| 3337562 | 4/1985 | Fed. Rep. of Germany . |
| 2125626 | 7/1984 | United Kingdom . |

*Primary Examiner*—H. Broome

*Attorney, Agent, or Firm*—Walter Ottesen

[57] ABSTRACT

The invention is directed to an overcurrent-protective switch for household appliances such as a vacuum cleaner. The snap switch has a housing in which a contact mounting unit is mounted at one end of the housing and contains one of two current terminals of the switch. The other current terminal is mounted at the other end of the housing and is configured to define a contact-engaging surface. A resilient interrupting contact member is fixedly connected to the one current terminal and has a metal center strip by means of which it is held in one of two end positions. In the first end position, the contact member is held in contact engagement with the contact-engaging surface of the other current contact terminal and, in the second end position, it is disengaged from the contact-engaging surface. When the center resistance strip is cool, the contact member is in its first position and the current circuit between the two current terminals is closed. On the other hand, when excessive current passes through the center strip, the latter heats and expands causing the contact member to snap over into the second position to interrupt the current circuit between the two current terminals. A reset plunger returns the contact member to its first position.

11 Claims, 4 Drawing Sheets

OVERCURRENT-PROTECTIVE SNAP SWITCH FOR HOUSEHOLD APPLIANCES

FIELD OF THE INVENTION

The invention relates to an overcurrent-protective snap switch for household appliances such as a floor-cleaning apparatus. The snap switch has a housing and two fixed contact pieces which are mounted in the housing. The fixed contact pieces also serve as the current terminals of the switch. An elongated resilient interrupting contact member has an inner end and an outer end and is fixedly connected to one of the fixed contacts at the inner end thereof. The interrupting contact member has a center strip configured as a resistance element and two side strips arranged on respective longitudinal sides of the center strip. The interrupting contact member is movable between a first position wherein said outer end is held in contact engagement with the other contact piece thereby closing the current path between said two fixed contact pieces and a second position wherein the outer end of the interrupting contact member is held in disengagement from the other contact member thereby interrupting the current path between the fixed contact pieces. The interrupting contact member is held in the first position in that the center strip is stressed and is cold and the side strips are prestressed. The interrupting contact member snaps into the second position after the center strip becomes heated to a predetermined level by the flow of an overcurrent therethrough. After the center strip has cooled, the interrupting contact member can be returned to its first position with the aid of a reset plunger actuated from outside of the housing.

BACKGROUND OF THE INVENTION

Overcurrent-protective snap switches provide immediate protection against overcurrent damage when the electrical motor is blocked in household apparatus such as vacuum cleaners in that the switches automatically interrupt the supply of current to the motor and the normal operating condition is reestablished only after the switches are manually reset.

German Pat. No. 1,513,242 discloses an overcurrent-protective snap switch wherein two movable contact arms are arranged in parallel. On the one hand, the ends of these two parallel arms are disposed in a two-part mounting bracket and the free-swinging end carries a contact. The thin center tongue is electrically connected to a terminal point; however, the center tongue is only held in a form-tight manner. The contact end transmits the electrical energy to the second connecting point via a contact with the aid of spring pressure. The thin center tongue thereby defines an electrical resistance element which expands in correspondence to the value of current exceeding the rated current and permits the free contact to snap out of its first end position thereby separating the contact pieces to interrupt the current. A manually actuable reset device is provided to reset the snap switch.

The above solution has the disadvantage however that when such overcurrent-protective snap switches are utilized in a floor-cleaning apparatus, the thin center tongue is often electrically and mechanically destroyed since the normal area of application for safety devices of this kind is for electronic devices such as hi-fi amplifiers and the like. It can be assumed on a statistical average that a floor-cleaning device is completely blocked at least once a week because of an object drawn in by suction when, for example, a carpet is vacuum cleaned. Even carpet tassels at the edge of the carpet can cause such a blockage when drawn into the vacuum cleaner by suction. The resulting current load from this blockage is then approximately 2.5 amperes at 220 volts for approximately 52 switching operations in a year. Because of the center tongue which is necessarily thin and which brings about the snap-switching action of the contacts and the electrical load, the arc does not always jump with certainty to the contacts provided during the switching operation; instead, the arc jumps to the forward region of the thin center tongue which then is subjected to a welding action. Further, the center tongue is then so intensely damaged that with the next "normal" switching operation, the thin metal segment mechanically breaks at this location.

SUMMARY OF THE INVENTION

Accordingly, it is an object of the invention to provide an overcurrent-protective snap switch of the above-described kind wherein the above-mentioned defect is prevented and a safe and long service life in the appliances of the above-mentioned type is assured. It is a further object of the invention to provide an overcurrent-protective snap switch wherein the arc associated with the switching action is directed to the locations provided therefor and wherein the mechanical loading of the thin center tongue is reduced.

BRIEF DESCRIPTION OF THE DRAWINGS

The invention will now be described with reference to the drawing wherein.

DESCRIPTION OF THE PREFERRED EMBODIMENTS OF THE INVENTION

Figure 1:
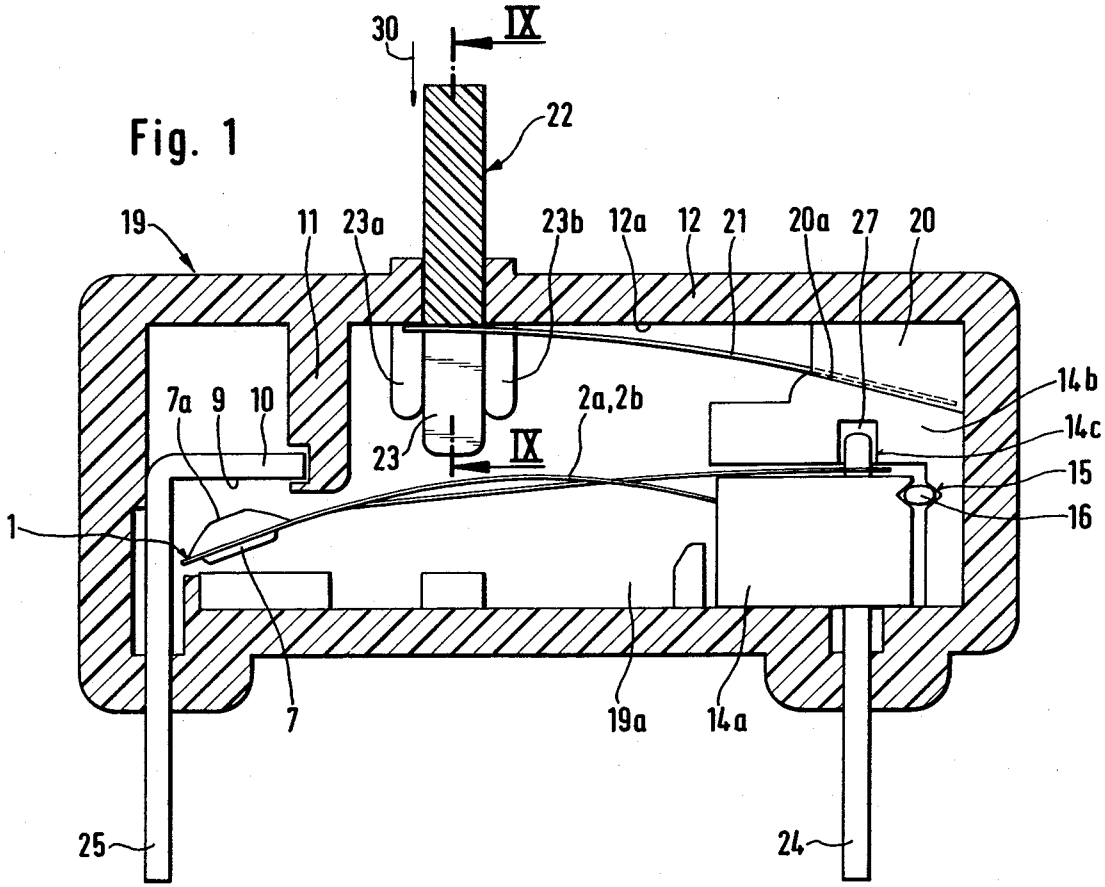
FIG. 1 is schematic of an overcurrent-protective snap switch to a preferred embodiment of the invention.

Referring to FIG. 1, the contact member 1 can be made of chrome-nickel steel, for example, and is mounted in the adjustable contact-mounting unit (14*a*, 14*b*) which comprises a lower block 14*a* and an upper block 14*b*, both made of electrically insulating material such as plastic. A two-part prismatic channel 15 is provided between blocks 14*a* and 14*b* in the rearward region thereof for accommodating an adjusting peg 16 having a predetermined diameter which is selected to maintain the contact region 27 constant. More specifically, the adjusting peg 16 is needed to ensure that the contact terminal 24 will be in alignment with the opening 14*c* formed in the upper block 14*b*.

Figure 2:
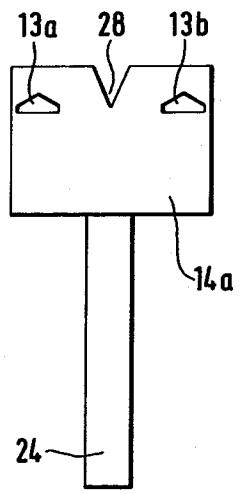
FIG. 2 is front elevation view of the lower contact mounting for mounting the elongated resilient interrupting contact member at the right-hand or inner end thereof.

In FIG. 2, a front elevation view of the lower block 14*a* of the contact-mounting unit (14*a*, 14*b*) is shown. The lower block 14*a* is provided with two triangular-shaped openings (13*a*, 13*b*) in which the respective outer legs (2*a*, 2*b*) of the U-shaped outer portion of the contact member 1 are inserted and held in a form-tight manner. The interrupting contact member 1 is a flat member and is shown more clearly in FIG. 3. The contact member includes a center tongue 3 which is integral with the base 5 and joins the latter via a formation 4 having a triangular shape with curved edges.

Figure 3:
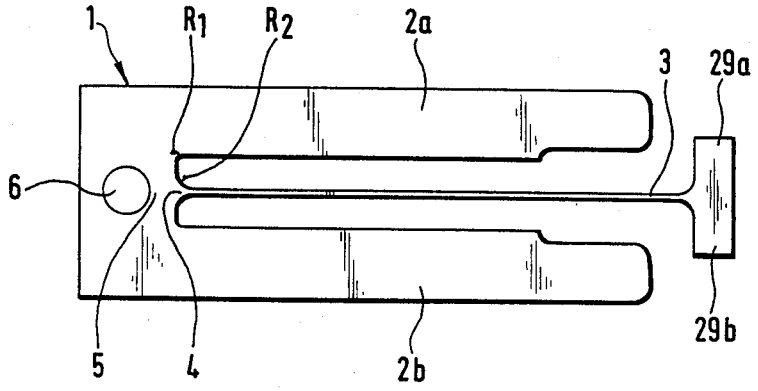
FIG. 3 is a plan view of the elongated resilient interruption member of the overcurrent-protective snap switch shown in FIG. 1.
Figure 4A:
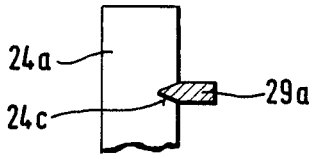
FIG. 4*a* is an enlarged side elevation view, in section, taken along line IV*a*–IV*a* of FIG. 4*b* and shows how the right-hand end of the center tongue is hooked into the right-hand contact terminal.
Figure 4B:
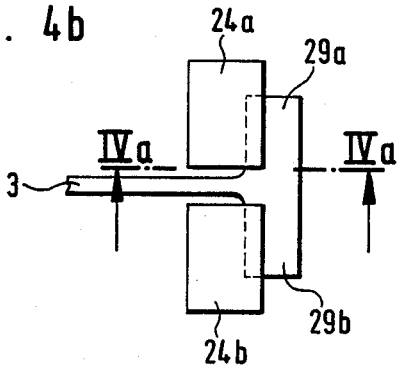
FIG. 4*b* is a plan view of the right-hand end of the center tongue and the right-hand contact terminal shown in FIG. 4*a;*

Referring to FIGS. 1, 3, 4*a* and 4*b*, the center tongue 3 of the interrupting contact member 1 lies in the V-shaped notch 28 formed in the lower block 14*a* of the mounting unit (14*a*, 14*b*). The center tongue 3 is T-shaped at its right-hand end and is hooked into the upper portion of the contact terminal 24 which is bifurcated and has two notched prongs (24*a*, 24*b*) in the contact region 27 thereof. The laterally extending side portions (29*a*, 29*b*) of the center tongue 3 hook into respective notches 24*c* in prongs (24*a*, 24*b*) of contact terminal 24 so that the contact member 1 is mechanically defined. The center tongue 3 is held in the adjustable contact-mounting unit (14*a*, 14*b*) and is electrically connected with the contact terminal 24 as shown in FIGS. 4*a* and 4*b*.

The left-hand or outer end of the interrupting contact member 1 is free to swing between first and second positions and carries a contact 7 on its contact mounting surface 6. The contact 7 has a mesa-like shape defining a contact engaging surface 7*a* which comes into contact engagement with the contact surface 9 in the forward region 10 of the contact terminal 25 when the contact member 1 is in its first position thereby assuring a current flow between the two terminals 24 and 25.

FIGS. 1 to 3 show the overcurrent-protective snap switch 19 of the invention which has a housing 12 made of insulating material and defining an inner chamber 19*a* wherein the interrupting contact member 1, the adjustable mounting unit (14*a*, 14*b*) and the fixed contact terminal 25 are mounted. The contact-mounting unit (14*a*, 14*b*) is braced against the plastic socket 20 and a return spring 21 is embedded in the socket 20 near the interface 20*a* between the latter and upper block 14*b*.

Figure 9:
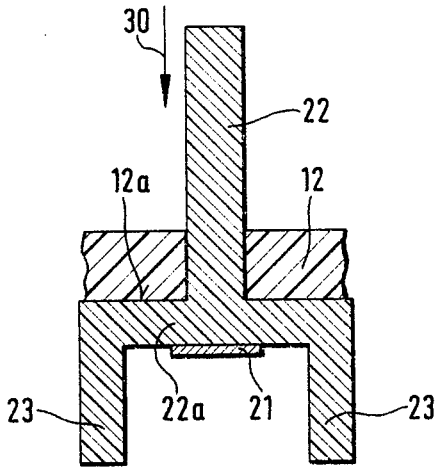

The return spring 21 lies with its left-hand end against the base 22*a* of the reset plunger 22 and resiliently biases the reset plunger 22 upwardly into its normal at-rest position against the inside wall surface 12*a* of housing 12 as shown in FIGS. 1 and 9. The reset plunger 22 is bifurcated at its lower end in the region of the center tongue 3 as shown in FIG. 9 so that its downwardly extending legs 23 straddle the center tongue 3 and come into contact engagement with the outer strips (2*a*, 2*b*) of the contact spring 1 when the reset plunger 22 is pressed downwardly in the direction of arrow 30. In this way, the outer legs (2*a*, 2*b*) of the contact member 1 are pressed downwardly whereas the thin center leg 3 is tightly held at its inner end in the mounting unit (14*a*, 14*b*). The legs 23 of the reset plunger 22 are guided in the housing by guides (23*a*, 23*b*) formed integrally with switch housing 12 made of plastic.

After being displaced in the downward direction by the reset plunger 22, the outer legs (2*a*, 2*b*) snap through and the contact 7 comes into electrically conductive contact engagement with the stationary contact surface 9 so that an electrical connection between the fixed contact terminals 24 and 25 is established.

If the current flow through the center tongue 3 of the contact member 1 increases as a consequence of a disturbance in the consumer such as the vacuum cleaner referred to above, then the thin center tongue 3 heats because of its resistance and expands. As a consequence of the spring-return force of the outer legs (2*a*, 2*b*), the contact member 1 again snaps into its second position and separates contact 7 from the contact surface 9 of contact terminal 25. The formation 4 at the base 5 of the U-shaped spring shown in FIG. 3 becomes stressed because of bending.

Figure 5:
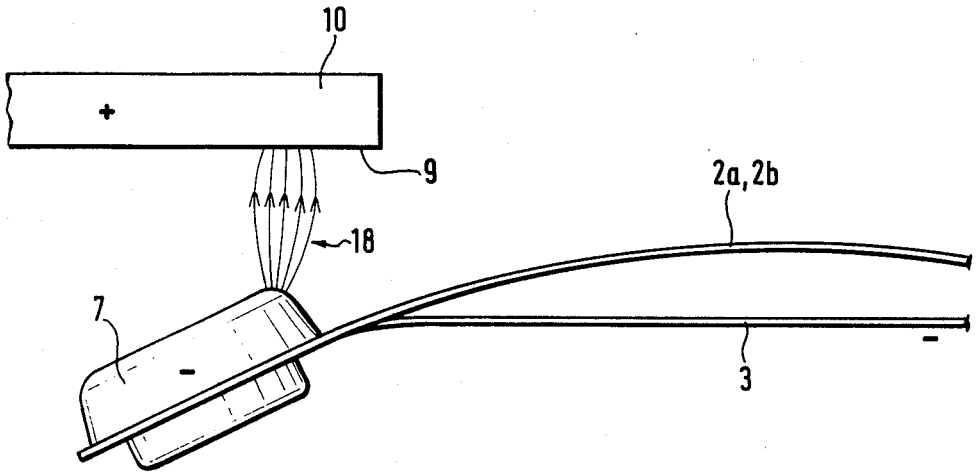
FIG. 5 is a schematic showing the path of the arc between the mesa contact of the interrupting contact member and the fixed contact associated therewith during a switching operation.

If it were not for the features of the invention to be explained below, the above switching action would cause the arc 18 to jump in an uncontrolled manner onto the thin center tongue 3. The arc 18 is caused by the electric field E which forms during the switching action. To prevent the arc from reaching and damaging the thin center segment of the interrupting contact member 1, the contact surface 7*a* of the contact 7 is configured to have a mesa-like shape with rounded edges as shown in FIGS. 1, 4 and 5. With the mesa-like contact, the electric field 18 can follow the path shown in FIG. 4 thereby avoiding damage to the center segment 3 at the region of the formation 4.

According to another feature of the invention, the area on the base 5 for accommodating the contact 7 thereon is increased by configuring the formation 4 to have a shape which is triangular with curved sides having a radius of curvature R2 greater than the radius of curvature R1 as shown in FIG. 3. For example, the first radius of curvature R1 is approximately 0.5 mm and the second radius of curvature R2 is approximately 2 mm.

Figure 6:
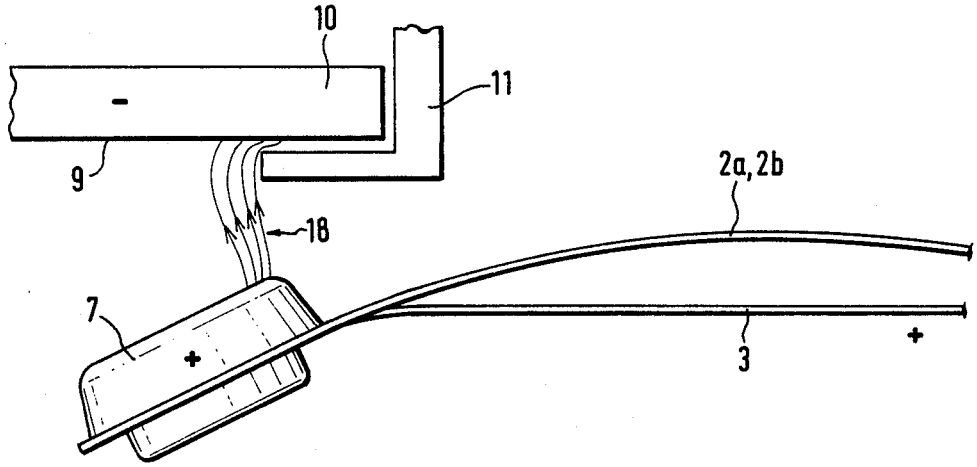
FIG. 6 is a schematic corresponding to that of FIG. 5 showing schematically how an insulating member functions to alter the path of the arc so that it terminates at a location on the mesa contact which is even farther away from the thin metal center segment of the interrupting contact member.

According to still another feature of the invention, an insulating projection 11 can be formed on the switch housing 12 to aid in preventing the arc from reaching the thin center strip 3. The insulating projection 11 is formed on the switch housing 12 so as to be integral therewith. The insulating projection 11 is formed so that it extends beneath the forward region 10 of the contact surface 9 as shown in FIGS. 1 and 6. In this way, it is assured that the arc will not move in the direction of the thin center tongue 3 and damage the same as well as the triangular-shaped portion 4 of the strip 3 shown in FIG. 3.

Figure 7:
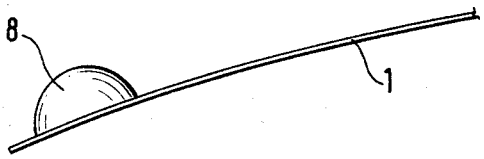
FIG. 7 is a side elevation view, in section, showing an alternate embodiment of the contact of an interrupting contact member wherein the contact has a hemispherical shape.
Figure 8:
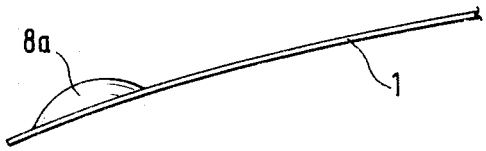
FIG. 8 is a side elevation view, in section, of still another embodiment of the contact of the interrupting contact member wherein the contact has a shape corresponding to a portion of a hemisphere; and, FIG. 9 side elevation view, in section, taken along line IX—IX of FIG. 1 and shows a portion of the housing and the reset plunger.

The contact 7 of the interrupting contact member 1 can be configured to have a hemispherical shape 8 as shown in FIG. 7. Another advantageous configuration for the contact is shown in FIG. 8 wherein the contact has the shape 8*a* of the upper portion of a hemisphere.

It is understood that the foregoing description is that of the preferred embodiments of the invention and that various changes and modifications may be made thereto without departing from the spirit and scope of the invention as defined in the appended claims.

What is claimed is:

1. An overcurrent-protective snap switch for household appliances such as a vacuum cleaner, the overcurrent-protective snap switch comprising:

a housing;

a first current terminal fixedly mounted in said housing;

a second current terminal fixedly mounted in said housing spaced from said first current terminal and defining a fixed contact surface;

a metal resilient U-shaped contact member having a base and two outer legs extending from said base, the contact member also having a center strip extending from said base and terminating in an outer end and being disposed between said outer legs;

said center strip being electrically and mechanically connected to said first current terminal at said outer end thereof;

said contact member having contact means mounted on said base and being movable between a first position wherein said outer legs are pretensioned to hold said contact means in contact engagement with said contact surface so as to define a closed current path between said current terminals and a second position wherein said contact means is separated from said contact surface and said current path is interrupted;

said center strip being configured as a resistance element which heats and expands in response to an overcurrent passing therethrough so as to cause said center strip to become stressed and snap said contact member into said second position;

said base of said U-shaped contact member having an inside edge from which said center strip extends and said outer legs having respective inside edges facing said center strip, each of said inside edges of said outer legs being joined with the inside edge of said base so as to define a first curved transition edge having a first radius of curvature R1;

said center strip having respective outside edges facing corresponding ones of said inside edges of said outer legs and said center strip extending from said inside edge of said base so as to cause each of said outer edges and said inside edge of said base to conjointly define a second curved transition edge having a second radius of curvature R2 greater than said first radius of curvature R1 thereby increasing the surface area of said base for accommodating said contact means thereon; and, reset means for imparting a force to said outer legs to snap said contact member back into said first position after said center strip has cooled thereby again defining a closed current path between said current terminals.

2. The overcurrent-protective snap switch of claim 1, said center strip and said base conjointly defining an interface transition region having a shape which is triangular with curved sides defined by said second curved transition edges.

3. The overcurrent-protective snap switch of claim 2, said first radius of curvature R1 being approximately 0.5 mm and said second radius of curvature R2 being approximately 2 mm.

4. The overcurrent-protective snap switch of claim 1, said outer legs having respective outer ends and said snap switch further comprising a contact mounting unit for accommodating said first current terminal therein, said mounting unit including holding means for mounting said outer legs therein at said outer ends thereof.

5. The overcurrent-protective snap switch of claim 1, further comprising: a contact mounting unit having a lower block and an upper block for receiving said first current terminal and said outer end of said center strip therein; and, adjusting means for aligning said blocks relative to each other and relative to said first current terminal.

6. The overcurrent-protective snap switch of claim 5, said adjusting means comprising an opening conjointly defined by said blocks; and, an adjusting pin for insertion into said opening and having a thickness selected to provide the alignment of said blocks relative to each other and to said first current terminal.

7. The overcurrent-protective snap switch of claim 1, said contact means having a mesa-like configuration.

8. The overcurrent-protective snap switch of claim 1, said contact means having a hemispherical configuration.

9. The overcurrent-protective snap switch of claim 1, said contact means being configured to have the shape of the top portion of a hemisphere.

10. The overcurrent-protective snap switch of claim 1, wherein an arc develops between said contact surface and said contact means during the movement of said contact member between said first and second positions, said snap switch further comprising insulating means interposed between said contact surface and said center strip just ahead of said contact means to thereby divert the arc away from the region of said contact member whereat said center strip is joined to said base.

11. The overcurrent-protective snap switch of claim 10, said housing being made of electrically insulating material and said insulating means being an appendage integrally formed with said housing to extend between said contact surface and said center strip for diverting said arc.

* * * * *

UNITED STATES PATENT AND TRADEMARK OFFICE

CERTIFICATE OF CORRECTION

PATENT NO. : 4,821,009

DATED : April 11, 1989

INVENTOR(S) : Rolf Pirdzuns, Wolfgang Polligkeit and Michael Schluckebier

It is certified that error appears in the above-identified patent and that said Letters Patent is hereby corrected as shown below:

In column 2, line 35: insert -- a -- between "is" and "schematic".

In column 2, line 36: insert -- according -- between "switch" and "to".

In column 2, line 38: insert -- block -- between "mounting", first occurrence and "for".

In column 2, line 42: delete "ruption" and substitute -- rupting contact -- therefor.

Signed and Sealed this

Fourteenth Day of November, 1989

*Attest:*

JEFFREY M. SAMUELS

*Attesting Officer* *Acting Commissioner of Patents and Trademarks*